United States Patent [19]

Kosrow et al.

[11] Patent Number: 4,819,926

[45] Date of Patent: Apr. 11, 1989

[54] SLEEVE HANDLING DEVICE

[75] Inventors: Robert L. Kosrow, Hoffman Estates; Richard Prochut, Streamwood; Maximilian Adamski, Jr., Palatine, all of Ill.

[73] Assignee: Union Speical Corporation, Chicago, Ill.

[21] Appl. No.: 50,989

[22] Filed: May 18, 1987

[51] Int. Cl.[4] ..... B42C 1/00

[52] U.S. Cl. ..... 270/45

[58] Field of Search ..... 270/45, 12, 15; 271/18.3, 265, 268, 184, 185, 198; 112/10, 121.15, 262.3

[56] References Cited

U.S. PATENT DOCUMENTS

| | | | |
|---|---|---|---|
| 4,428,315 | 1/1984 | Keeton | 112/121.15 |
| 4,444,384 | 4/1984 | Keeton | 271/18.3 |
| 4,483,262 | 11/1984 | Keeton | 112/121.15 |
| 4,526,115 | 5/1985 | Kosrow et al. | 112/262.3 |
| 4,530,295 | 5/1985 | Adamski et al. | 112/121.15 |
| 4,531,721 | 5/1985 | Kosrow | 270/45 |
| 4,565,362 | 1/1986 | Wiley | 271/268 |
| 4,624,198 | 11/1986 | Beam et al. | 112/10 |

*Primary Examiner*—Robert E. Garrett
*Assistant Examiner*—Therese M. Newholm
*Attorney, Agent, or Firm*—Powell L. Sprunger

[57] ABSTRACT

A sleeve handling device comprising, a first moving conveyor, a second moving conveyor disposed at an angle to the first conveyor, and a device for picking up a cloth on the first conveyor at a central portion thereof. The sleeve handling device has a device for moving the picking up device to a location above the second conveyor and dropping off the folded cloth onto the second conveyor.

26 Claims, 6 Drawing Sheets

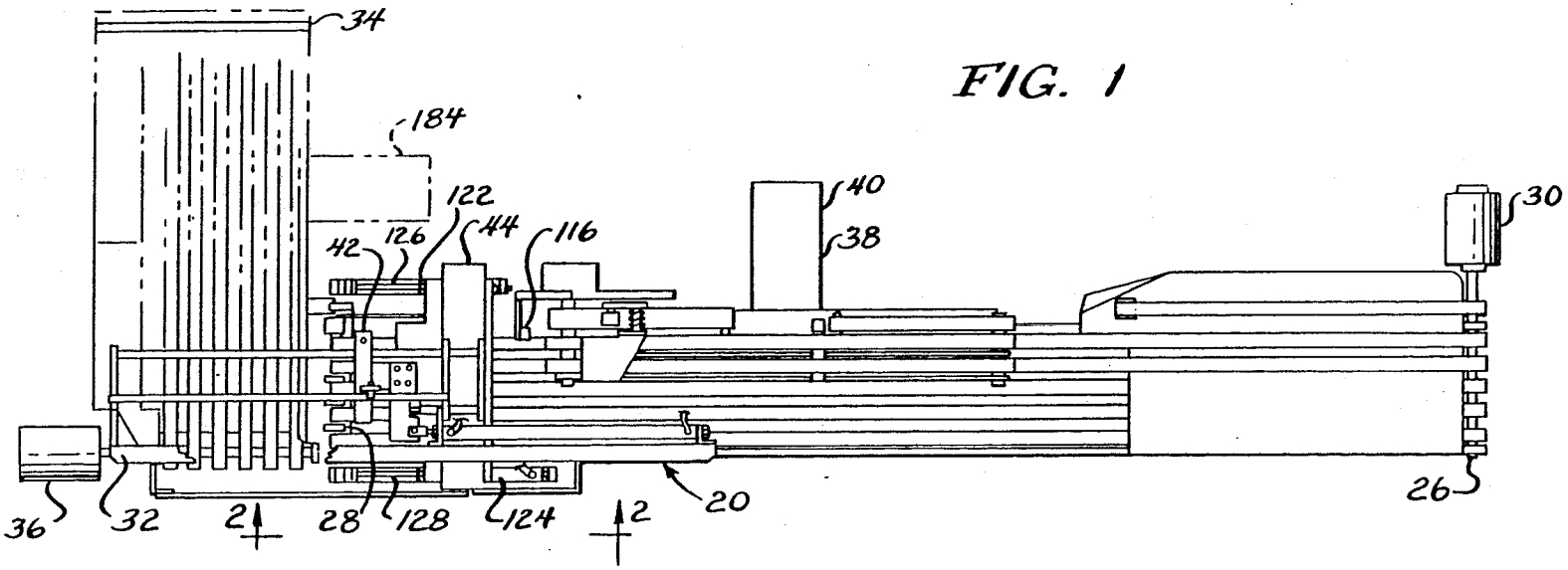
FIG. 1
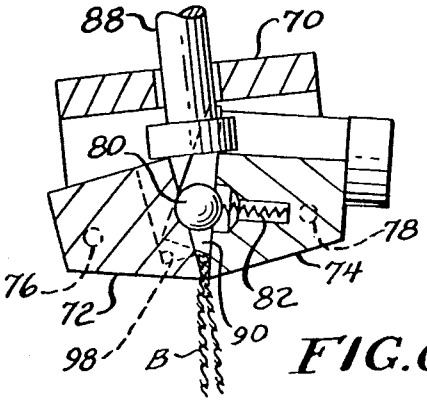
FIG. 6
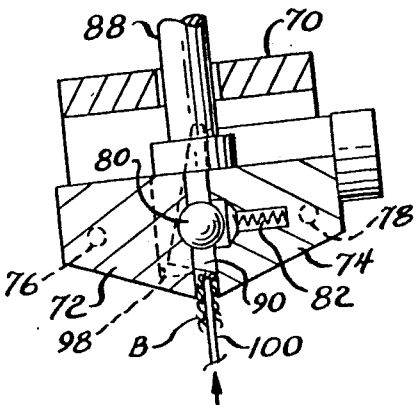
FIG. 5
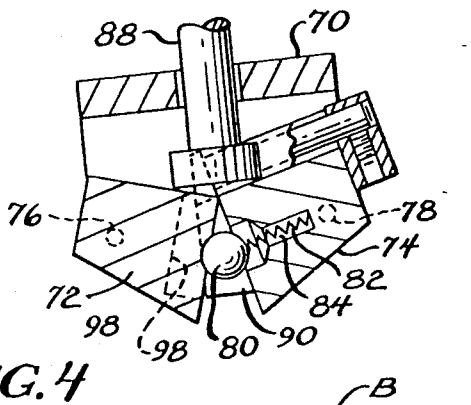
FIG. 4
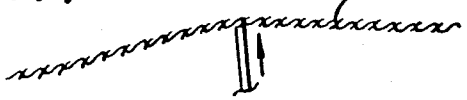

SLEEVE HANDLING DEVICE

CROSS REFERENCE TO RELATED APPLICATION

This application is related to application Ser. No. 050,990, filed May 18, 1987.

BACKGROUND OF THE INVENTION

The present invention relates to a sleeve handling device.

In the past, the commercial production of shirt sleeves, particularly T-shirt sleeves has been quite labor-intensive and expensive. A sleeve blank is cut from a larger piece of cloth, and then is fed by hand to a forming station whereat a hem is formed along one edge of the blank. The hem blank is then commonly manually removed from the forming station, folded over by hand, and passed by hand under an automatic sewing machine to form an arcuate seam along an edge of the blank generally transverse to the hem. Since many more sleeve blanks can be hemmed per unit time by the formation station than can be seamed, usually two or three workers are necessary to effect seaming for each forming station. This results in the sleeve formation operation being very labor-intensive and relatively expensive, and a substantial floor area is required to accommodate the necessary workers and machinery.

A sleeve making device is disclosed in U.S. Pat. No. 4,483,262, incorporated herein by reference. However, in this apparatus an arm is utilized to operate a cloth pickup device, and it is desirable to improve the accuracy of both the pickup of cloth from a first conveyor and the subsequent release of the cloth on a second conveyor in making the sleeve.

SUMMARY OF THE INVENTION

A principal feature of the present invention is the provision of an improved sleeve handling device.

The sleeve handling device of the present invention comprises, a first moving conveyor, and a second moving conveyor disposed at an angle to the first conveyor. The device has means for picking up a cloth on the first conveyor at a central portion thereof, and means for moving the picking up means to a location above the second conveyor and dropping off the folded cloth onto the second conveyor.

A feature of the present invention is that the length of the cloth on the first conveyor is measured, and the picking up means automatically picks up a central portion of the cloth irrespective of the length of the cloth.

Another feature of the invention is the provision of means for blowing the cloth against a side of the conveyor for proper registration of the cloth.

Yet another feature of the present invention is the provision of a tapered hem guide which separates plies of the cloth in order to align each ply for proper registration.

A further feature of the invention is the provision of means for sensing a trailing edge of the picked up cloth adjacent the second conveyor in order to determine the proper time to drop the cloth by the picking up means onto the second conveyor.

Another feature of the invention is the provision of means for clamping a trailing edge of the picked up cloth at approximately the time it is dropped onto the second conveyor.

Still another feature of the invention is that the sensor means may be adjusted in order to modify the trim of the dropped off cloth.

Further features will become more fully apparent in the following description of the embodiments of this invention and from the appended claims.

DESCRIPTION OF THE DRAWINGS

In the drawings:

FIG. 1 is a top plan view of a cloth handling device of the present invention;

FIG. 4 is a fragmentary sectional view of a cloth pick-up device showing jaws of the device in an open position;

FIG. 5 is a fragmentary sectional view of the device of FIG. 4 showing the jaws in an intermediate position;

FIG. 6 is a fragmentary sectional view of the device of FIG. 4 showing the jaws in a closed position;

DESCRIPTION OF THE PREFERRED EMBODIMENTS

Figures 2, 3:
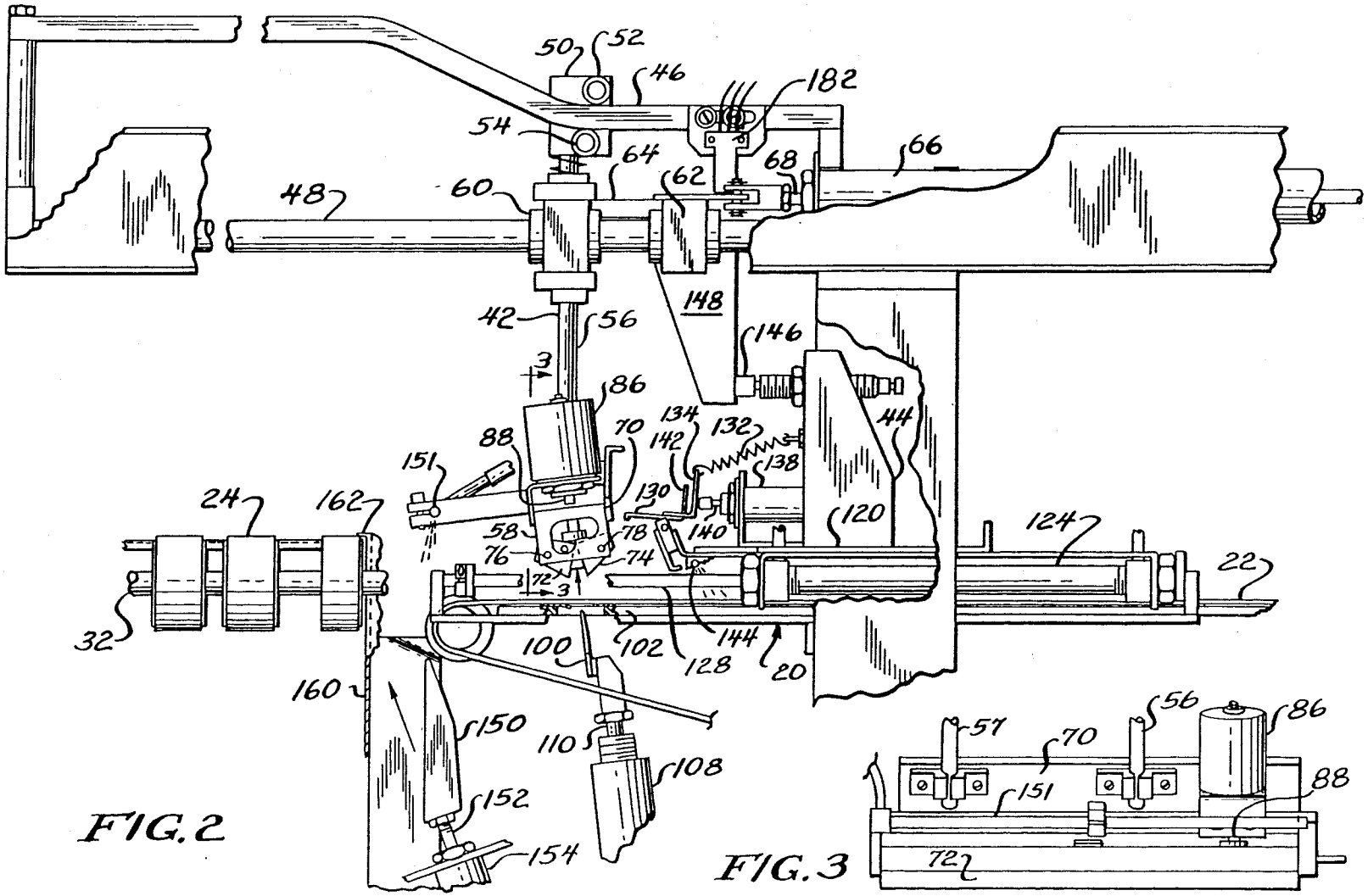
FIG. 2 is a fragmentary side elevational view of the device taken substantially as indicated along the line 2—2 of FIG. 1.
FIG. 3 is a fragmentary elevational view taken substantially as indicated along the line 3—3 of FIG. 2.

Referring now to FIGS. 1 and 2, there is shown a sleeve handling device generally designated 20 having a first conveyor 22, and a second conveyor 24 disposed generally at right angles to the first conveyor 22. The first conveyor 22 is disposed about a pair of spaced rotatable rollers 26 and 28, and the first conveyor 22 is driven by suitable means, such as a motor 30 operatively connected to the roller 26. The second conveyor 24 is disposed about a pair of spaced rotatable rollers 32 and 34, and the second conveyor 24 is driven by suitable means, such as a motor 36 operatively connected to the roller 32.

Figure 15:
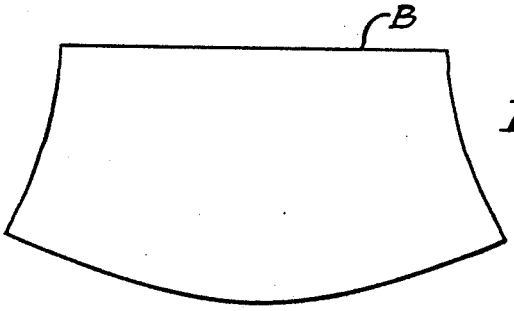
FIG. 15 is a plan view of a sleeve blank or cloth which is utilized in the device of FIG. 1.
Figure 16:
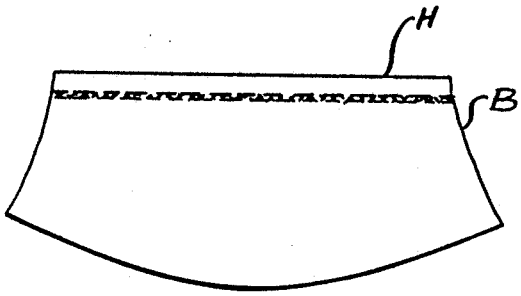
FIG. 16 is a plan view of the blank of FIG. 15 with a sewn hem.

With reference to FIG. 15, cloth or fabric sleeve blanks B are placed on the first conveyor 22 adjacent the roller 26, and the blanks B pass through a hemming station 38 including a sewing machine 40 for forming a hem H in the blanks B, as shown in FIG. 16. The hemming station 38 is of conventional nature, and does not form part of the present invention.

With reference to FIGS. 1 and 2, the sleeve handling device 20 has a cloth pickup device 42 and a carriage 44. The device 20 has an elongated bar 46 which is tapered upwardly from a location above the first conveyor 22 to a location above the second conveyor 24, with the second conveyor 24 being preferably located at a higher elevation than the first conveyor 22. The device 20 also has an elongated rod 48 which extends from a location above the first conveyor 22 past the second conveyor 24.

Figure 12:
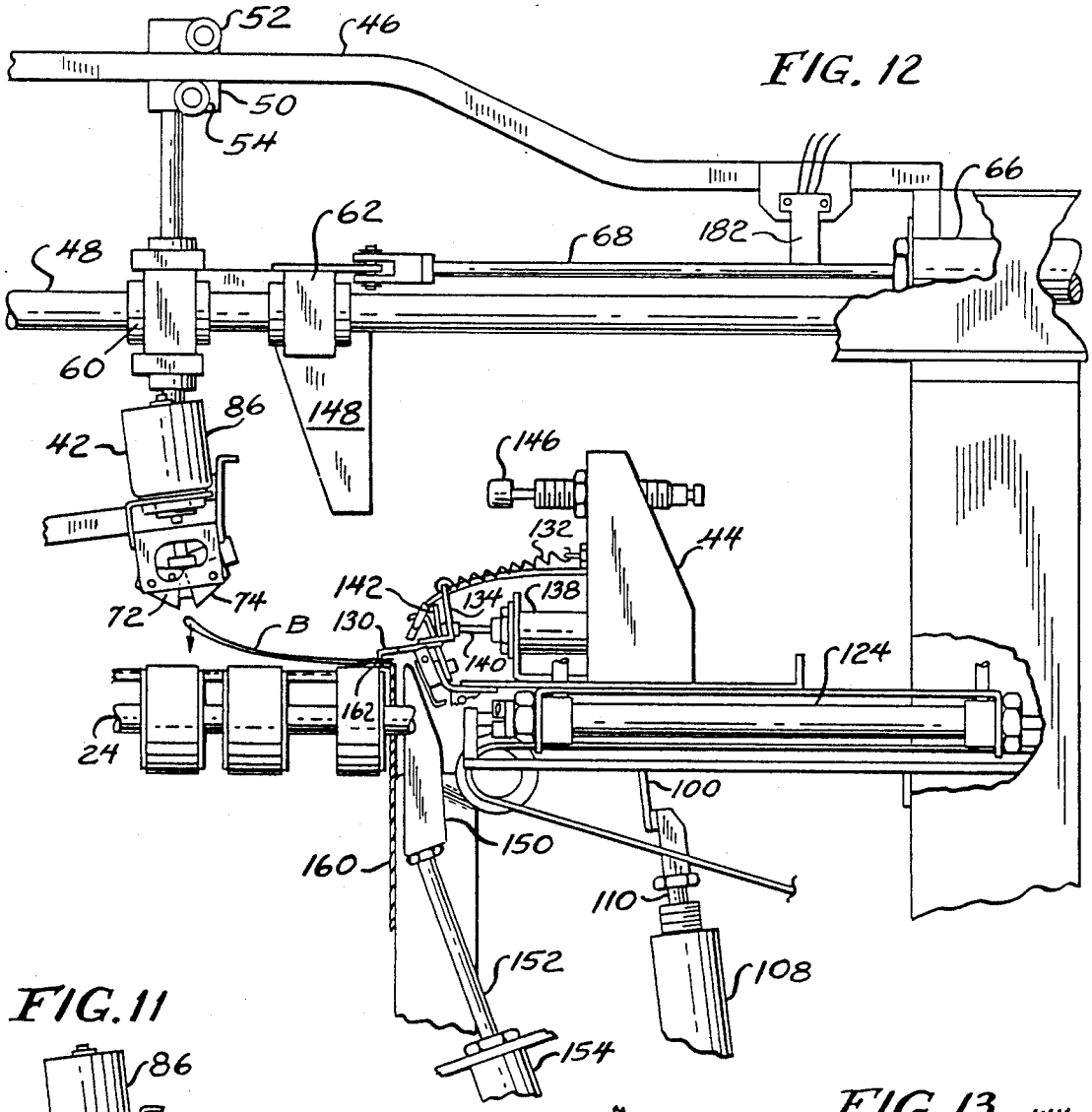
FIG. 12 is a fragmentary elevational view of the device of FIG. 1 showing the dropping of the cloth onto the second conveyor of the device of FIG. 1.

The cloth pickup device 42 has a housing 50 with a pair of spaced lower and upper rollers 52 and 54 which bear upon the bar 46, and permit movement of the pickup device 42 along the bar 46. The pickup device 42 has an elongated rod 56 connected to the housing 50 and supporting a jaw assembly 58. The pickup device 42 has a first bushing 60 slidably received on the rod 48, and the rod 56 is slidably received in the first bushing 60. The pickup device also has a second rod 57 supporting the jaw assembly 58. The pickup device 42 has a second bushing 62 connected to the first bushing 60 by a plate 64, with the second bushing 62 being slidably received on the rod 48. The pickup device 42 has a cylinder 66 with a piston 68 connected to the plate 64 which is controlled by the central processing unit 118 of FIG. 18. The cylinder 66 moves the pickup device 42 through the piston 68 from a first home position above the first conveyor 22, as shown in FIG. 2, to a second remote position, as shown in FIG. 12, above the second conveyor 24. During movement of the pickup device 42 from the first position to the second position, the housing 50, in addition to the rod 56 and jaw assembly 58, is raised by the bar 46 above the second conveyor 24 which is located at a higher position than the first conveyor 22. During movement of the pickup device 42 from the first to second position, the rod 56 slides in the first bushing 60 in order to raise the jaw assembly 58 above the second conveyor 24.

With reference to FIGS. 2–6, the jaw assembly 58 has an elongated housing 70 pivotally supporting first and second elongated tapered jaws 72 and 74 by a pair of respective pins 76 and 78. The jaws 72 and 74 are pivotally mounted by the pins 76 and 78 about first and second parallel axes such that the jaws are pivotable between a first position, as shown in FIG. 6, wherein they are in operative clamping position with respect to each other to clamp a piece of cloth therebetween, and a second open position, as shown in FIG. 4, in order to allow a piece of cloth to freely pass into a position between the jaws 72 and 74. The jaw assembly 58 has a ball 80 disposed between the jaws 72 and 74, and a helical spring 82 received in a recess 84 of the second jaw 74, such that the spring 82 biases the ball 80 from the second jaw 74 toward the first jaw 72. The spring 82 and ball 80 act directly upon the jaws 72 and 74 in order to maintain the jaws 72 and 74 in either of the first or second position as shown in FIGS. 6 and 4, once the jaws 72 and 74 are moved to that position from an intermediate position, as shown in FIG. 5.

The pickup device 42 has a cylinder 86 with a movable piston 88 which engages against the jaws 72 and 74. With the jaws in the first closed configuration, as shown in FIG. 6, the cylinder 86 may be actuated by the central processing unit 118 of FIG. 18 in order to drive the piston 88 against the jaws 72 and 74, and move the jaws 72 and 74 to the second open position, as shown in FIG. 4.

With reference to FIGS. 2–6 and 8, the jaw assembly 58 has an elongated plate 90 pivotally mounted on the jaw 74 by a pin 92. The plate 90 has a pair of opposed depending plate sections 94 and 96 disposed over a front surface of the second jaw 74. The plate 90 is received in a recess 98 of the first jaw 72 when the jaws 72 and 74 are moved from the open configuration, as shown in FIG. 4, to the closed configuration, as shown in FIG. 6.

With reference to FIGS. 1–6, and 8–10, the device 20 has an elongated actuating member 100 disposed beneath a bed 102 of the first conveyor 22. The actuating member 100 has a plurality of upwardly directed blades 104*a*, 104*b*, 104*c*, 104*d*, and 104*e* extending upwardly from a connecting portion 106. The device 20 has a cylinder 108 which moves a piston 110 connected to the actuating member 100. The blades 104*a* to 104*e* are aligned with openings 112*a*, 112*b*, 112*c*, 112*d*, and 112*e* in the bed 102, and the blades 104*b* and 104*d* of the actuating member 100 are aligned with the plate sections 94 and 96 of the plate 90. As shown, the blades 104*a*, 104*c*, and 104*e* have upwardly directed spaced pointed members 114. The cylinder 108 is controlled by the central processing unit 118 of FIG. 18 and moves the actuating member 100 between a first position with the blades 104*a* to e beneath the bed 102 to a second position with the blades or fingers 104*a* to e passing through the openings 112*a* to e into a configuration above the bed 102 where the blades 104*b* and 104*d* engage against the plate sections 94 and 96 of the plate 90 and move the jaws 72 and 74 to their closed configuration, as shown in FIG. 6, after which the actuating member 100 is retracted to the first lower position beneath the bed 102. During movement of the actuating member 100 from the first lower position to the second upper position, the pointed members 114 engage against the cloth in order to more positively retain and move the cloth between the open jaws 72 and 74. The plate 90 is pivotally mounted in the jaw assembly 58 in order to take up tolerances during actuation by the fingers 104*b* and 104*d* of the actuating member 100.

With regard to FIG. 1, when the hemmed blank B of cloth as shown in FIG. 16 passes from the hemming station 38, the hemmed blank B passes beneath a photosensor 116. The photosensor 116 senses the leading and trailing edge of the hemmed blank B as it passes beneath the photosensor 116, and provides this information to the central processing unit 118 of FIG. 18. The central processing unit 118 determines the length of the cloth blank B based upon the information provided by the photosensor 116 as determined by the time between sensing the leading and trailing edges of the blank B, and by knowing the speed of the first conveyor 22. Thus, the photosensor 116 and central processing unit 118 determines the length of the blank B. The central processing unit 118 also knows the distance from the photosensor 116 to the actuating member 100, and the actuation time required to move the actuating member 100 from the first lower position to the second upper position. Thus, the central processing unit 118 calculates the time at which the lateral central portion of the cloth blank B is located shortly before the actuation member, and the central processing unit 118 actuates the cylinder 108 to move the actuating member through the bed 102 against the cloth blank B where the pointed members 114 of the blades 104*e*, c, and e catch the cloth blank B and move it upwardly between the jaws 72 and 74 while the blades 104*b* and 104*d* of the actuating member 100 strike the plate 90 and close the jaws 72 and 74 which capture the lateral central portion of the cloth blank B after which the actuating member 100 retracts to its lower position beneath the bed 102. In this manner, the pickup device 42 captures the lateral central portion of the cloth blank B irrespective of the length of the cloth blank B passing through the hemming station 38.

In this manner, the pickup device 42 captures the cloth blank B in the lateral central portion with improved accuracy since the pickup device 42 is at a stationary position and the actuating member 100 moves the cloth blank B between the jaws 72 and 74 and closes the jaw with precision irrespective of the length of the cloth blank B. In addition, the pickup device 42 and actuating member 100 results in an improved pickup of the cloth blank B, and results in a more uniform and deeper grab of the cloth blank B between the jaws 72 and 74. Further, the pickup device 42 of the present invention results in a more reliable pickup of the cloth blank B, and results in a more accurate dropping of the cloth blank B on the second conveyor 24, as will further be described below.

Figure 7:
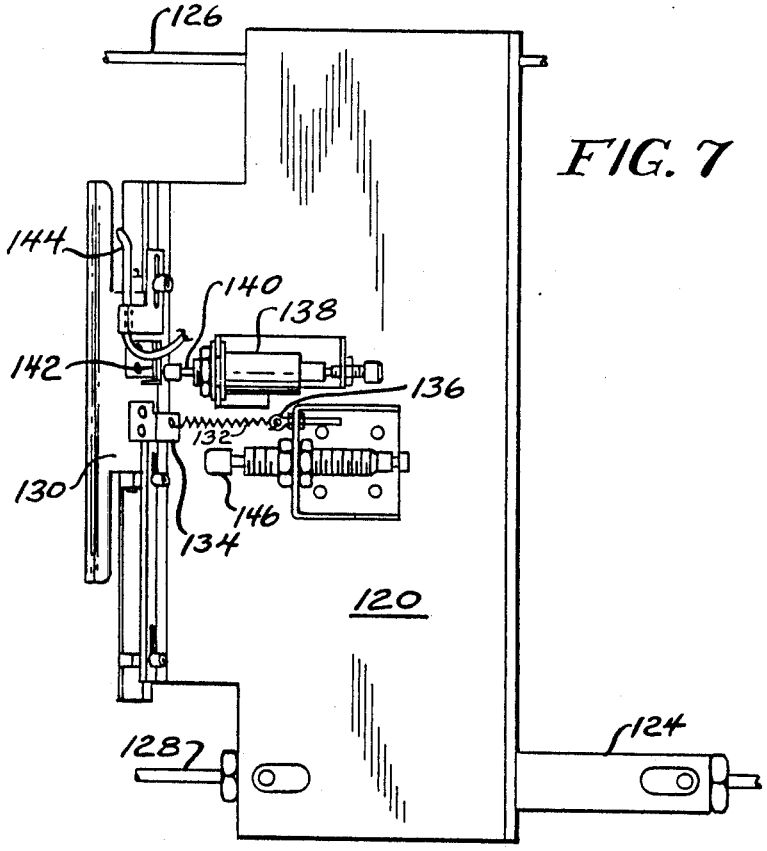
FIG. 7 is a top plan view of a carriage for the device of FIG. 1.
Figure 8:
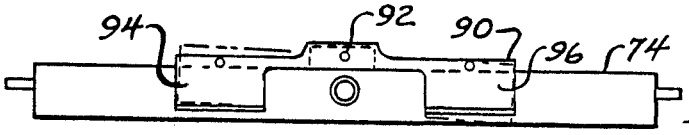
FIG. 8 is a side elevational view of one of the jaws of the device of FIG. 4.
Figure 9:
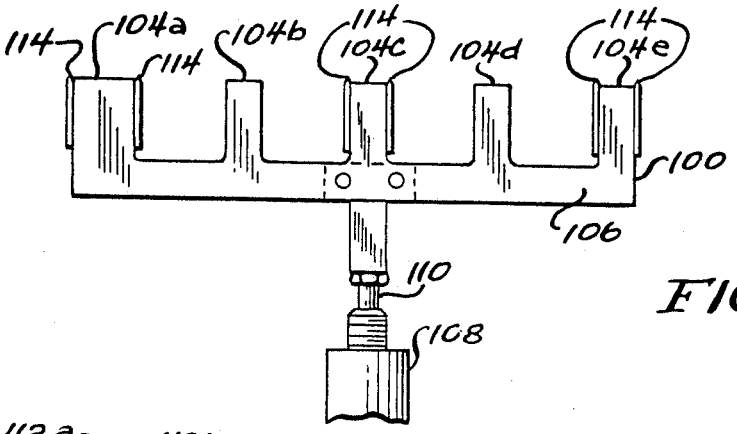
FIG. 9 is a fragmentary elevational view of an actuating device for the jaws in the device of FIG. 4.
Figure 10:
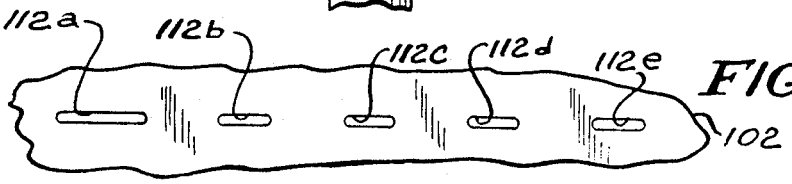
FIG. 10 is a fragmentary plan view of a portion of a bed in a first conveyor of the device of FIG. 1.
Figure 18:
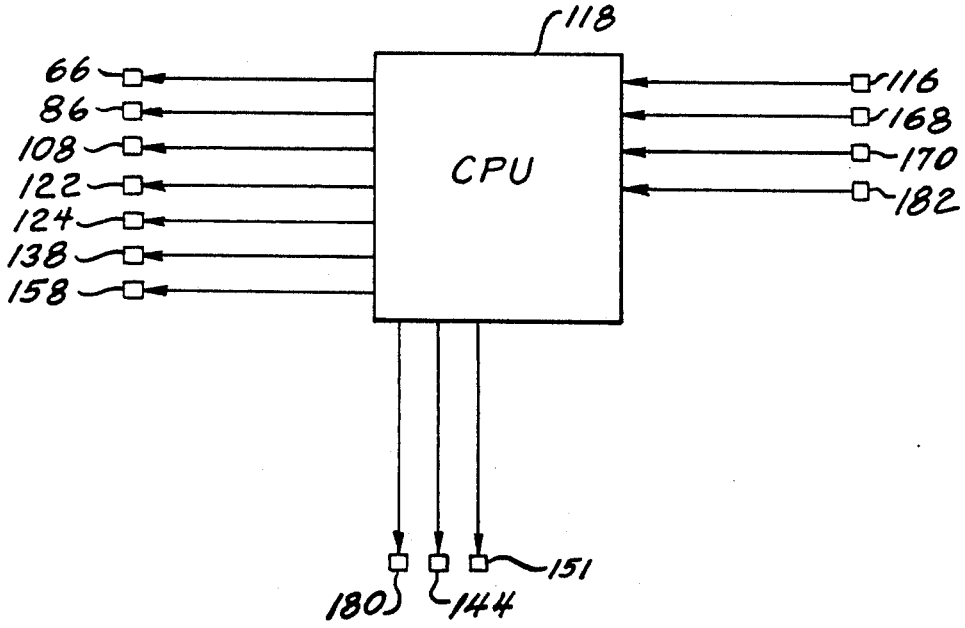
FIG. 18 is a diagrammatic view illustrating operation of a central processing unit of the present invention.

With reference to FIGS. 1, 2, and 7, the carriage 44 located adjacent the cloth pickup device 42 has an elongated plate 120 which is secured to a pair of cylinders 122 and 124 which move along a pair of respective rods 126 and 128, with the cylinders 122 and 124 being actuated by the central processing unit 118 of FIG. 18. The cylinders 122 and 124 move the carriage 44 from a first home position, as shown in FIGS. 1 and 2 to a second remote position, as shown in FIG. 12. The carriage 44 has a forward clamp member 130 pivotally mounted on the forward portion of the carriage 44. The carriage 44 has a helical spring 132 connected between a flange 134 on the clamp member 130 and a fixed pin 136, such that the spring 132 normally biases the clamp member 130 into an upper position. The carriage 44 has a cylinder 138 actuated by the central processing unit 118 of FIG. 18 with a movable piston 140 which engages against a flange 142 on the clamp member 130. When the cylinder 138 is actuated, the piston moves the flange 142 and clamp member 130 to a lower clamping position against the bias of the spring 132. The carriage 44 also has an elongated tube 144 which serves as a blower for a purpose which will be described below. The carriage 44 has a central bumper 146 which engages against a depending flange 148 of the pickup device 42 when the pickup device 42 and carriage 44 are returned to the first home position.

Figure 14:
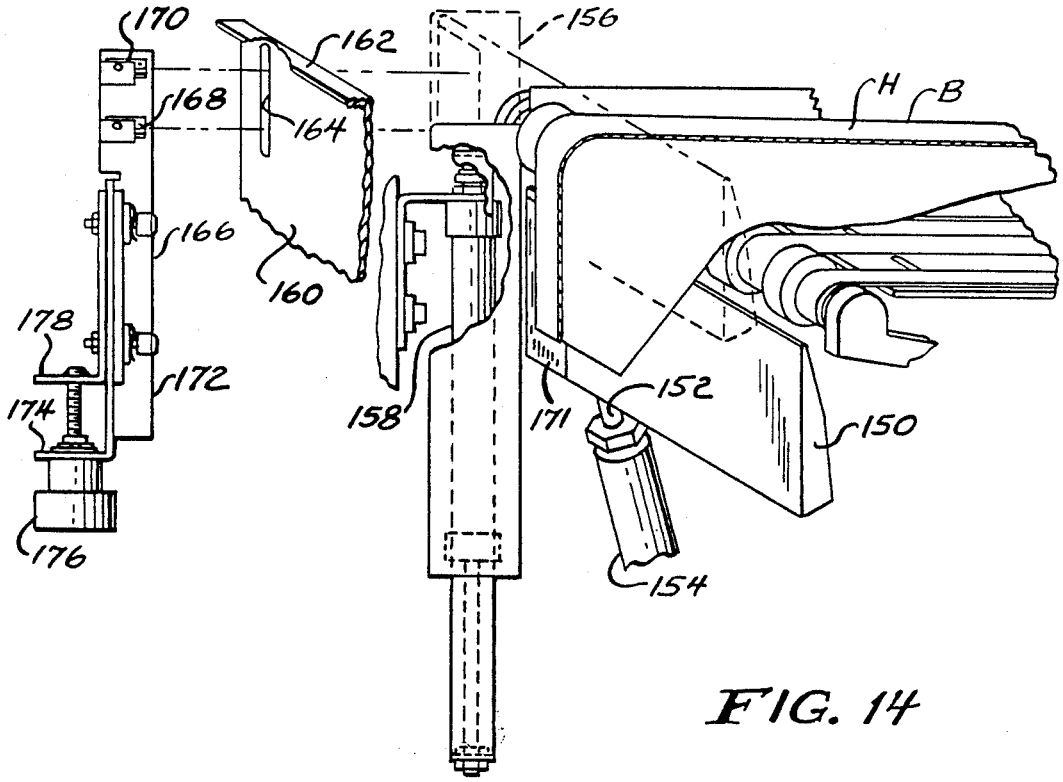
FIG. 14 is a fragmentary exploded view of a portion of the device of FIG. 1 near an end of the first conveyor.

With reference to FIG. 14, prior to pickup of the cloth blank B by the pickup device 42, the leading edge of the blank B passes around the forward end of the first conveyor 22 and over a side of an elongated tapered lower hem guide 150, while a blower 151 of the pickup device passes air against the blank B as actuated by the central processing unit 118. The hem guide 150 is connected to a piston 152 extending from a cylinder 154 which is actuated by the central processing unit 118 of FIG. 18. As will further be discussed below, the lower hem guide 150 is moved between a first lower position as shown in solid lines to a second upper position shown in phantom lines.

With reference to FIG. 14, the sleeve handling device 20 has an elongated edge guide 156 which is connected to a cylinder 158 which is controlled by the central processing unit 118 of FIG. 18. The cylinder 158 moves the edge guide 156 between a first lower position beneath the top of the first conveyor 22 to a location above the first conveyor 22.

With further reference to FIG. 14, the device 20 has an elongated plate 160 located adjacent the second conveyor 24 and having an upper outwardly directed flange 162. As shown, the plate 160 has an elongated vertical slot 164 extending through the plate 160.

Figure 11:
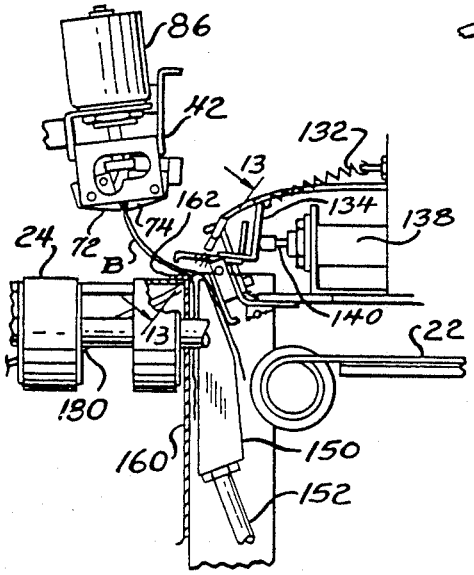
FIG. 11 is a fragmentary elevational view showing the device of FIG. 1 transporting a cloth or fabric to a second conveyor.
Figure 13:
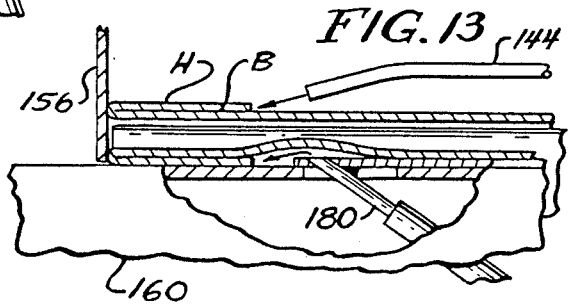
FIG. 13 is a fragmentary sectional view taken substantially as indicated along the line 13—13 of FIG. 11.

The device 20 has a sensor unit 166 mounted on an elongated plate 172 adjacent the plate 160 with a first lower sensor 168 and a second upper sensor 170 aligned with the slot 164 of the plate 160, with the sensors 168 and 170 being aligned with a reflective surface 171 of the lower hem guide 150. The plate 172 is connected to an outwardly directed lower flange 174. The sensor unit 166 has a threaded adjustment member 176 passing through openings of the flange 174 and a flange 178 of the sensor unit 166. Through movement of the adjustment member 176 the heights of the plate 172 and the corresponding first and second sensors 168 and 170 may be vertically adjusted relative to the slot 164 of the plate 160 for a purpose which will be described below. With reference to FIGS. 11 and 13, the device 20 has a tube 180 adjacent the plate 160 which serves as a second blower.

After the cloth blank B has been picked up by the pickup device 42, the central processing unit 118 actuates the cylinder 158 in order to raise the edge guide 156 to a location above the first conveyor 22. The central processing unit 118 also actuates the blowers 144 and 180 at this time. The central processing unit 118 actuates the cylinder 66 in order to move the pickup device 42 toward its second position above the second conveyor 24, and simultaneously actuates the cylinders 122 and 124 to move the carriage 44 from the home position toward the second remote position alongside the pickup device 42. After the pickup device 42 begins to move toward its second position, the central processing unit 118 actuates cylinder 154 in order to move the lower hem guide 150 from its first lower position to its second upper position to a location between the two plies of the picked up cloth blank B while the lower blower 180 and upper blower 144 blow against the lower and upper plies of the cloth blank B in order to cause registration of the blank B against the edge guide 156. In this manner, the pickup device 42 and carriage 44 are moved toward the second remote position, as shown in FIG. 11.

When the trailing edge of the cloth blank B uncovers the lower sensor 168 of the sensor unit 166, the central processing unit 118 turns off the blowers 144 and 180 and actuates the cylinder 158 in order to lower the edge guide 156. At this time, the pickup device 42 and carriage 44 move a little distance further toward the second position, as shown in FIG. 12, and the trailing edge of the cloth blank B uncovers the second upper sensor 170 as determined by the central processing unit 118. As a result, the central processing unit 118 actuates the cylinder 138 of the carriage 44 in order to lower the clamp member 130 against the flange 162 of the plate 160 in order to clamp the trailing edge of the cloth blank B therebetween, and ascertain that the folded blank B will be located correctly on the second conveyor 24. At approximately the same time, the central processing unit 118 actuates the cylinder 86 of the pickup device 42 in order to open the jaws 72 and 74 of the jaw assembly 58, and release the cloth blank B onto the second conveyor 24. Shortly thereafter, the central processing unit 118 actuates the cylinder 138 in order to retract the piston 140, such that the spring 132 returns the clamp 130 to its upper position spaced from the flange 162 of the plate 160 in order to release the cloth blank B on the second conveyor 24.

Figure 17:
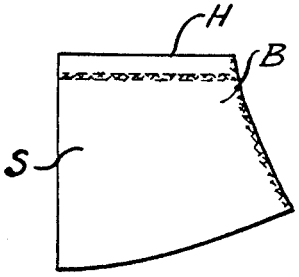
FIG. 17 is a plan view of the blank as sewn into the configuration of a sleeve.

After the cloth blank B has been placed on the second conveyor 24, the central processing unit 118 actuates the cylinder 154 in order to lower the lower hem guide 150 to its first lower position. At the same time, the central processing unit 118 actuates the cylinder 66 of the pickup device 42 and the cylinders 122 and 124 of the carriage 44 in order to return the pickup device 42 and carriage 44 toward its home position. The device 20 has a metal detector 182 mounted on the bar 46, and senses through the central processing unit 118 when the pickup device 42 and carriage 44 are returned to their first home position for subsequent operation of the actuating member 100 on a subsequent cloth blank B. With reference to FIGS. 1 and 12, the folded cloth blank B placed on the second conveyor 24 moves toward a sewing station 184 where the cloth blank B is trimmed and sewn into the configuration of a sleeve S, as shown in FIG. 17.

With reference to FIG. 14, as previously discussed, the height of the first and second sensors 168 and 170 may be adjusted by the adjustment member 176 relative to the slot 164 of the plate 160. Through adjustment of the sensors 168 and 170, the amount of trim in the sewing station 184 of FIG. 1 is controlled, such that if the sensors 168 and 170 are lowered relative to the slot 164, the sleeve blank B is trimmed an additional amount by the sewing station 184. In an ideal situation, the sensors 168 and 170 are moved to the maximum vertical position in order to minimize the amount of trim in the sewing station 184. However, the sensors 168 and 170 may be moved to a lowermost position, and the central processing unit 118 may introduce a time delay to modify the drop off time after the trailing edge of the cloth blank B is uncovered by the sensors 168 and 170.

The foregoing detailed description is given for clearness of understanding only, and no unnecessary limitations should be understood therefrom, as modifications will be obvious to those skilled in the art.

What is claimed is:

1. A sleeve handling device, comprising:

a first moving conveyor;

a second moving conveyor disposed at an angle to the first conveyor;

means for picking up a cloth on the first conveyor and folding the cloth at a central portion thereof;

means for moving the picking up means to a location above the second conveyor and dropping off the folded cloth onto the second conveyor including means for blowing the cloth toward the first conveyor.

2. The device of claim 1 including an edge guide adjacent one side of the first conveyor and intermediate the first and second conveyors, and means for blowing the lower and upper sides of the folded cloth against the edge guide.

3. The device of claim 2 including means for moving the edge guide from a first lower position below an upper surface of the first conveyor to a second upper position above the upper surface of the first conveyor.

4. The device of claim 3 including an elongated tapered lower hem guide, and means for moving the hem guide between a first lower position to a second position between plies of the cloth in the picking up means.

5. The device of claim 4 including a first lower sensor adjacent the second conveyor for sensing the trailing edge of the cloth in the picking up means.

6. The device of claim 5 including means responsive to the first sensor for turning off the blowing means, and means for lowering the edge guide.

7. The device of claim 6 including a second upper sensor adjacent the second conveyor for sensing the trailing edge of the cloth in the picking up means.

8. The device of claim 7 including means responsive to the second sensor for clamping a trailing edge of the cloth in the picking up means, means for releasing the cloth in the picking up means on the second conveyor, and means for releasing the clamping means on the trailing edge of the cloth.

9. The device of claim 8 including means responsive to the second sensor for lowering the hem guide.

10. The device of claim 8 including means responsive to the second sensor for returning the picking up means to an initial position for picking up a subsequent cloth.

11. The device of claim 1 wherein the second conveyor is located at a position above the first conveyor, and including means for raising the picking up means as it passes toward the second conveyor.

12. The device of claim 7 including means for adjusting the position of the first and second sensors relative to the trailing edge of the cloth in the picking up means.

13. The device of claim 8 including means for delaying release of the cloth from the picking up means after sensing of the trailing edge of the cloth by the second sensor.

14. The device of claim 1 including an elongated tapered lower hem guide, and means for moving the hem guide between a first lower position to a second position between plies of the cloth in the picking up means.

15. A sleeve handling device, comprising:

a first moving conveyor;

a second moving conveyor disposed at an angle to the first conveyor;

means for picking up a cloth on the first conveyor at a central portion thereof;

means for moving the picking up means to a location above the second conveyor;

means for sensing a trailing edge of the cloth adjacent the second conveyor;

means responsive to the sensing means for clamping a trailing edge of the fabric;

means responsive to the sensing means for dropping the cloth from the picking up means onto the second conveyor; and means for releasing the clamping of the trailing edge of the cloth.

16. A sleeve handling device, comprising:

a first moving conveyor;

a second moving conveyor disposed at an angle to the first conveyor;

means for picking up a cloth on the first conveyor at a central portion thereof;

means for moving the picking up means to a location above the second conveyor;

a carriage including a clamping member;

means for moving the carriage along with the picking up means;

means for clamping a trailing edge of the cloth by the clamping member adjacent the second conveyor;

means for releasing the cloth by the picking up means; and means for releasing the trailing edge of the fabric by the clamping member.

17. The device of claim 16 wherein the carriage includes means for blowing the fabric toward one side of the conveyor.

18. The device of claim 16 including means for returning the picking up means and carriage to an initial position for picking up a subsequent cloth.

19. A sleeve handling device, comprising:

a first moving conveyor;

a second moving conveyor disposed at an angle to the first conveyor;

an elongated bar extending between the first conveyor and second conveyor;

an elongated first rod extending between the first conveyor and the second conveyor;

a pickup device comprising, a housing having a pair of lower and upper rollers disposed on a lower and upper surface of the bar, a bushing slidably received on the first rod, a jaw assembly having a pair of elongated jaws being movable between a first closed position and a second open position, an elongated second rod slidably received in the bushing and connecting the housing to the jaw assembly;

means for moving the jaws between the first position to second position;

means for moving the jaws between the second position to the first position;

means for moving the pickup device from a first position above the first conveyor to a second position above the second conveyor;

a carriage having a forwardly directed clamping member, and means for moving the clamping member between a first upper position and a second lower clamping position;

means for moving the carriage between a first position above the first conveyor and a second position adjacent the second conveyor;

a clamping flange adjacent the second conveyor;

means for sensing a trailing edge of a cloth received in the pickup device adjacent the second conveyor, said pickup device being moved along with the carriage from the first and second position with a folded cloth being received in the pickup device, with the trailing edge of the cloth being clamped against the clamping flange, and the pickup device releasing the folded cloth on the second conveyor after which the pickup device releases the cloth on the second conveyor.

20. The device of claim 19 wherein the carriage includes a blower directed toward a side of the first conveyor against an upper surface of the folded cloth.

21. The device of claim 19 wherein the device includes a blower directed toward a side of the first conveyor against a lower surface of the cloth.

22. The device of claim 19 wherein the pickup device includes a forwardly directed blower directed against an upper surface of the cloth on the first conveyor.

23. The device of claim 19 wherein the second conveyor is located at a higher elevation than the first conveyor, and in which the bar is tapered upwardly from the first conveyor toward the second conveyor.

24. The device of claim 19 wherein the carriage has a forwardly directed bumper engaging against the pickup device when the pickup device and carriage are located at the first position.

25. A sleeve handling device, comprising:

a first moving conveyor;

a second moving conveyor disposed at an angle to the first conveyor;

means for picking up a cloth on the first conveyor and folding the cloth at a central portion thereof;

means for moving the picking up means to a location above the second conveyor and dropping off the folded cloth onto the second conveyor, including an edge guide adjacent one side of the first conveyor and intermediate the first and second conveyors, and means for blowing the lower and upper sides of the folded cloth against the edge guide.

26. A sleeve handling device, comprising:

a first moving conveyor;

a second moving conveyor disposed at an angle to the first conveyor;

means for picking up a cloth on the first conveyor and folding the cloth at a central portion thereof;

means for moving the picking up means to a location above the second conveyor and dropping off the folded cloth onto the second conveyor, including an elongated lower hem guide, and means for moving the hem guide between a first lower position to a second posiiton between plies of the cloth in the picking up means.

* * * * *